US007007644B2

(12) United States Patent
Tai et al.

(10) Patent No.: US 7,007,644 B2
(45) Date of Patent: Mar. 7, 2006

(54) SYSTEM AND METHOD FOR PREVENTING PISTON-VALVE COLLISION ON A NON-FREEWHEELING INTERNAL COMBUSTION ENGINE

(75) Inventors: Chun Tai, Hagerstown, MD (US); Timothy A. Suder, Greencastle, PA (US); Walter Curtis Jacques, Smithsburn, MD (US); Benjamin C. Shade, Masontown, WV (US)

(73) Assignee: Mack Trucks, Inc., Allentown, PA (US)

( * ) Notice: Subject to any disclaimer, the term of this patent is extended or adjusted under 35 U.S.C. 154(b) by 0 days.

(21) Appl. No.: 10/726,688

(22) Filed: Dec. 4, 2003

(65) Prior Publication Data

US 2005/0120986 A1 Jun. 9, 2005

(51) Int. Cl.
*F01L 9/02* (2006.01)

(52) U.S. Cl. ..... 123/90.12; 123/90.13; 123/90.11; 123/90.6

(58) Field of Classification Search ..... 123/90.11, 123/90.12, 90.13
See application file for complete search history.

(56) References Cited

U.S. PATENT DOCUMENTS

| | | | | |
|---|---|---|---|---|
| 1,377,297 | A | | 5/1921 | Werner |
| 1,473,077 | A | | 11/1923 | Bull |
| 2,459,960 | A | | 1/1949 | Perisse |
| 2,703,076 | A | | 3/1955 | Chaude |
| 3,439,662 | A | | 4/1969 | Jones et al. |
| 4,510,900 | A | | 4/1985 | Quenneville |
| 4,572,114 | A | | 2/1986 | Sickler |
| 5,339,777 | A | | 8/1994 | Cannon |
| 5,537,976 | A | * | 7/1996 | Hu ..... 123/322 |
| 5,839,453 | A | | 11/1998 | Hu |
| 6,092,495 | A | | 7/2000 | Hackett |
| 6,273,057 | B1 | | 8/2001 | Schwoerer et al. |
| 6,321,701 | B1 | | 11/2001 | Vorih et al. |
| 6,321,703 | B1 | * | 11/2001 | Diehl et al. ..... 123/90.12 |
| 6,591,795 | B1 | * | 7/2003 | Janak ..... 123/90.12 |
| 2002/0056435 | A1 | | 5/2002 | Yang et al. |
| 2002/0134328 | A1 | | 9/2002 | Chiappini et al. |
| 2002/0148421 | A1 | | 10/2002 | Wiekmeijer |
| 2002/0157624 | A1 | | 10/2002 | Janak |
| 2003/0000488 | A1 | | 1/2003 | Burgdorf et al. |
| 2003/0005898 | A1 | | 1/2003 | Gianolio et al. |

* cited by examiner

*Primary Examiner*—Thomas Denion
*Assistant Examiner*—Ching Chang
(74) *Attorney, Agent, or Firm*—Rothwell, Figg, Ernst & Manbeck, PC

(57) ABSTRACT

A valve actuation system and method for use in an internal combustion engine including at least one combustion cylinder having a piston and an engine valve. The valve actuation system includes a hydraulic pump, a high-pressure reservoir, and an electro-hydraulic valve actuator. The hydraulic pump is configured to produce a hydraulic output based on a valve-piston clearance profile of at least one cylinder of the combustion engine. The high-pressure reservoir is coupled with the hydraulic pump. The electro-hydraulic valve actuator is coupled with the high-pressure reservoir via a first control valve and configured to actuate at least one engine valve of the combustion engine according to an output of the hydraulic pump.

11 Claims, 2 Drawing Sheets

SYSTEM AND METHOD FOR PREVENTING PISTON-VALVE COLLISION ON A NON-FREEWHEELING INTERNAL COMBUSTION ENGINE

BACKGROUND OF THE INVENTION

1. Field of the Invention

The present invention generally relates to an electro-hydraulic device for actuating a control element of an internal combustion engine. More particularly, the present invention relates to a system and method for regulating a high-pressure hydraulic supply to electro-hydraulic engine valve actuators.

2. Description of the Background Art

The internal combustion engine is well known and has garnered much attention since its creation. Because of its ubiquitous use, substantial efforts are constantly made to improve designs for the internal combustion engine and for its control systems. Of the many advancements made, independent valve actuation and electronic fuel injection were conceived to improve performance and efficiency over cam-based engines.

With independent valve actuation systems, the engine valves can come in contact with the engine pistons. This valve—piston collision can cause serious engine damage leading to engine failure. Therefore, valve actuation systems are contemplated that prevent such valve-piston collisions from occurring.

Piston-valve collision has been of particular concern for electro-hydraulic valve-trains on non-freewheeling engines, such as heavy-duty diesel engines. The current solution for solving this problem relies heavily on feedback control based upon valve lift measurements, which is neither reliable nor cost effective. For example, U.S. Pat. No. 6,092,495 describes a method of controlling electronically controlled valves to prevent interference between the valves and a piston. While the system can prevent piston-valve collision, it is flawed because a failure in the electrical control system could cause severe engine damages.

Thus, there is a need for new and improved systems and methods for valve control in a combustion engine that provide reliable piston-valve clearance.

SUMMARY OF THE INVENTION

According to one aspect of the present invention, a system and method are provided for regulating high-pressure hydraulic supply to an electro-hydraulic valve actuator. The present invention provides reliable piston-valve clearance.

Another aspect of the present invention is generally characterized in a valve actuation system for use in an internal combustion engine comprising at least one combustion cylinder having a piston and an engine valve. The valve actuation system includes a hydraulic pump, a high-pressure reservoir, and an electro-hydraulic valve actuator. The hydraulic pump is configured to produce a hydraulic output based on a valve-piston clearance profile of the cylinder of the combustion engine. The high-pressure reservoir is coupled with the hydraulic pump. The electro-hydraulic valve actuator is coupled with the high-pressure reservoir and configured to actuate at least one engine valve of the combustion engine according to an output of the hydraulic pump.

The above and other features and advantages of the present invention will be further understood from the following description of the preferred embodiments thereof, taken in conjunction with the accompanying drawings wherein like reference numerals are used throughout the various views to designate like parts.

DETAILED DESCRIPTION OF THE PREFERRED EMBODIMENTS

Figure 1:
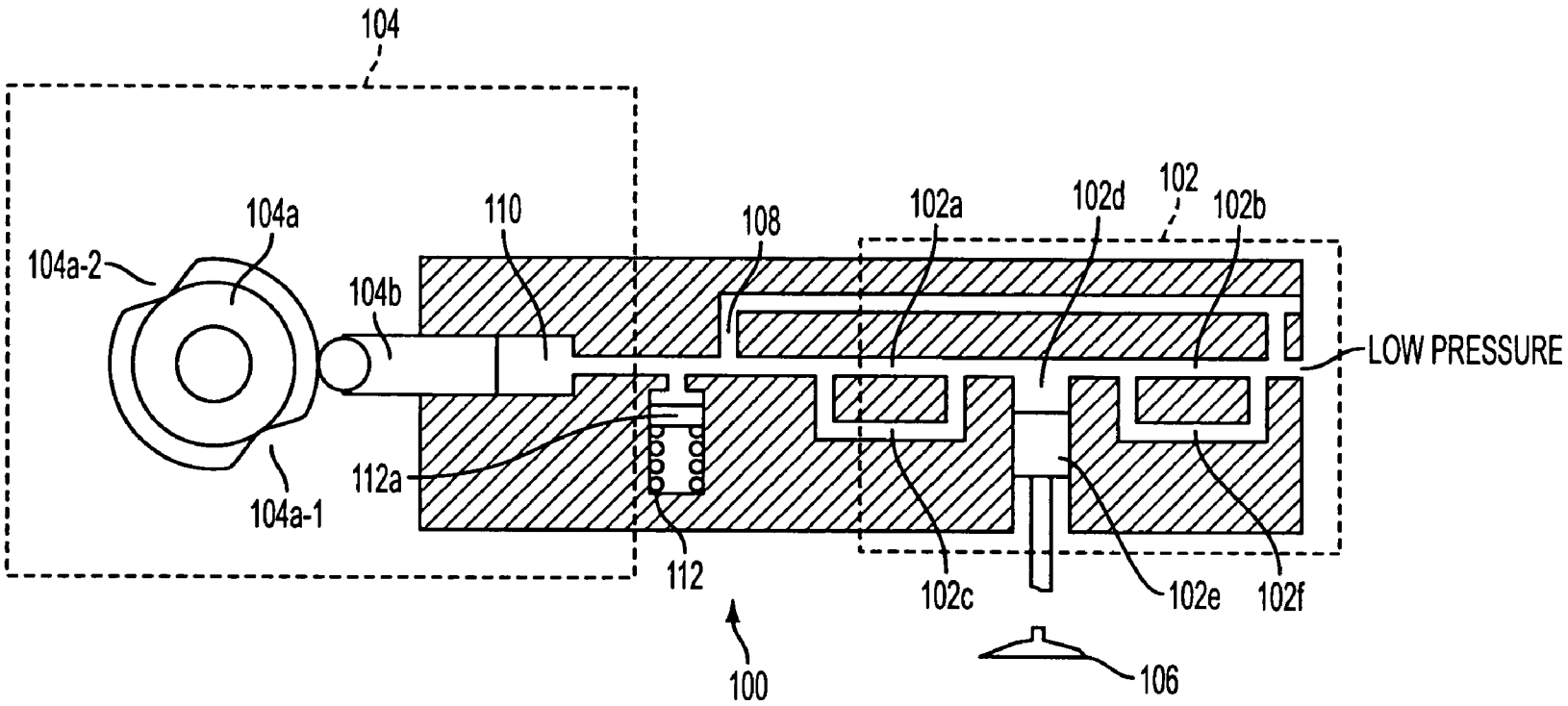
FIG. 1 is a schematic diagram showing an embodiment of an electro-hydraulic valve actuation system for a combustion engine according to the present invention.

An embodiment of an internal combustion engine 100 having an electro-hydraulic valve actuation system according to the present invention is shown in FIG. 1. The engine 100 includes at least one piston-driven combustion cylinder (not shown) in communication with at least one engine control valve 106 (e.g., intake or exhaust valve), an electro-hydraulic actuator 102 for opening and closing valve 106, and a hydraulic pump 104. The hydraulic pump 104 may be a cam-driven pump and is fluidly connected to the electro-hydraulic valve actuator via a high-pressure reservoir 110.

In the embodiment shown in FIG. 1, hydraulic pump 104 includes a plunger 104*b* that is driven by a cam 104*a*. The geometry (i.e., shape) of the cam 104*a* can be selected to drive the plunger 104*b* as desired to charge the pressure of the fluid in the high-pressure reservoir 110. Preferably, the geometry of the cam is selected based on the piston-valve clearance curve for the combustion cylinder, such that when the engine piston is moving close to the valve 106, the high-pressure begins to drop; that is, the cam 104*a* starts to move away from the plunger 104*b*. For example, as shown in FIG. 1, cam 104*a* may have concave portions 104*a*-1 and 104*a*-2 corresponding to a crank angle of the engine when the engine piston moves close to the engine valve 106, thereby allowing plunger 104*b* to move toward cam 104*a* when piston-valve clearance becomes small.

Electro-hydraulic actuator 102 includes control valves 102*a* and 102*b*, which are preferably electric solenoid valves, check valves 102*c* and 102*f*, control chamber 102*d*, and a plunger 102*e*. Control valves 102*a* and 102*b* can be opened and shut to control the direction of plunger 102*e* to actuate the engine valve 106, and can be controlled electronically, such as via an electronic control unit (ECU) or processor (not shown). Control valve 102*a* (high-pressure control valve) allows high-pressure hydraulic fluid to travel into the control chamber 102*d*, to force the plunger 102*e* to travel away toward valve 106. Hydraulic fluid may be allowed to return to the high-pressure reservoir 110 via check valve 108 one-way only. Opening control valve 102*b* (low-pressure control valve) allows high-pressure fluid in the control chamber 102*d* to travel to low-pressure, which may be connected to a low-pressure hydraulic fluid supply, such as a regulated low-pressure reservoir (not shown). Check valve 102*f* allows hydraulic fluid to flow back to the control chamber 102*d*, should the pressure in control chamber 102*d* decrease below the pressure of the low pressure hydraulic fluid supply.

Check valve 102*c* allows fluid to flow from the control chamber 102*d*, one-way only, to the high-pressure reservoir 110, when the pressure in the control chamber 102*d* exceeds the pressure in the high-pressure reservoir 110. Thus, even when control valve 102*b* is closed, check valve 102*c* creates a feedback loop—as the cam 104*b* moves away from the plunger 104*a*, the pressure in the high-pressure reservoir 110 begins to drop below the pressure in the control chamber 102*d*, and check valve 102*c* opens. Thus, piston-valve collision can be prevented reliably without reliance on electronic control systems.

A hydraulic accumulator 112 is in fluid connection to the high-pressure reservoir 110. The accumulator 112 is able to store excessive hydraulic fluid when the high-pressure control valve 102*a* is closed and yet plunger 104*a* continues to pump fluid into reservoir 110. The piston 112*a* of the accumulator tends to respond to low-pressure fluctuation more than high frequency fluctuation. Here, the pressure drop due to the cam 104*a* shape design as the engine piston moves close to the valve 106 is high frequency. Therefore, the accumulator 112 is preferably slow to react to this fluctuation, which allows the pressure to fluctuate to a significant level such that the check valve 102*c* can open.

In operation, the cam-driven hydraulic pump 104 supplies high-pressure hydraulic fluid to the electro-hydraulic valve actuator 102. The cam 104*a* is preferably mechanically linked to the engine crankshaft (not shown) with a 2:1 ratio (i.e., the engine crankshaft rotates two revolutions while the cam 104*a* rotates one revolution). The cam profile is preferably shaped to correspond to the piston-valve clearance profile, so that as the engine piston moves toward the engine valves and the instantaneous piston-valve clearance becomes smaller, the pump plunger 104*b* moves toward the cam 104*a*. As the plunger 104*b* moves toward the cam 104*a*, the hydraulic pressure in high-pressure reservoir 110 drops. As a result, check valve 102*c* opens and high-pressure hydraulic fluid travels from control chamber 102*d* to reservoir 110, which allows the engine valve 106 to move away from the engine piston to avoid piston-valve collision even when control valve 102*b* is still closed. Control valves 102*b* is opened to allow hydraulic fluid to return to the low-pressure region. Control valves 102*a* and 102*b* are closed, and as the engine piston moves away from top-dead center position, the hydraulic pressure in the high-pressure reservoir 110 is built back up. Control valve 102*a* is then opened to cycle engine valve 106 for the next combustion event.

Figure 2:
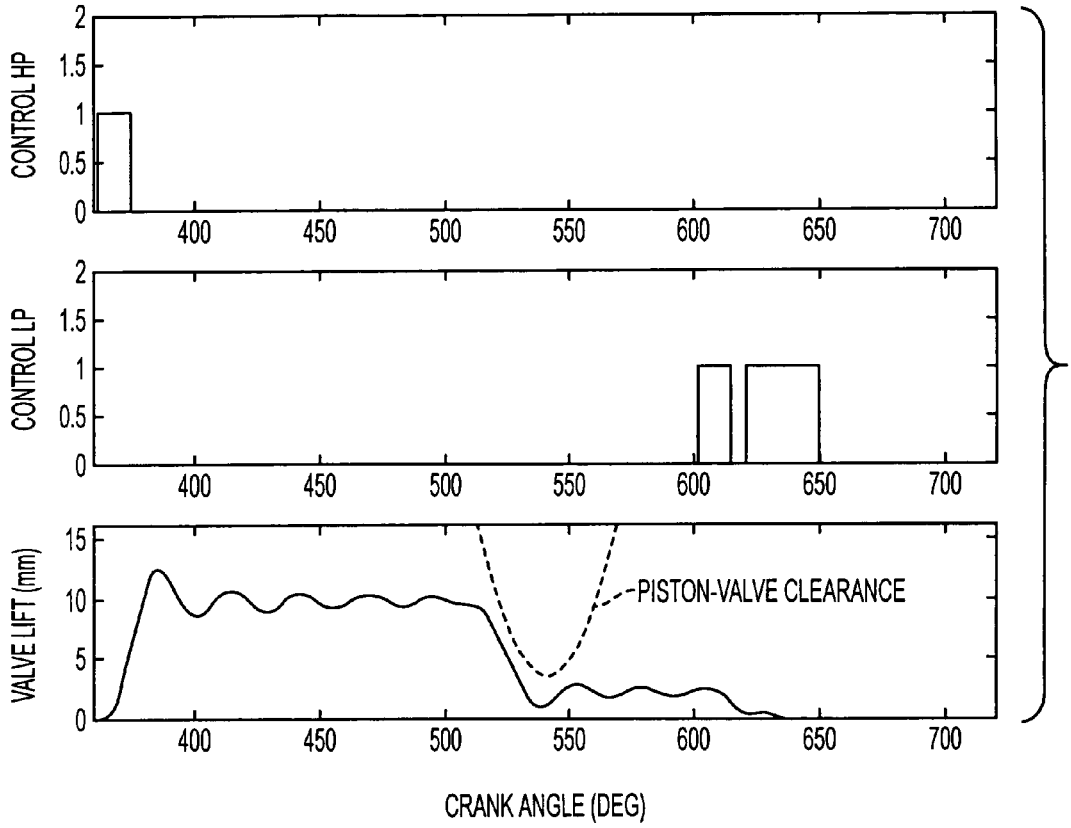
FIG. 2 is a graph of the piston-valve clearance characteristics of a computer simulation of the present invention.

Referring now to FIG. 2, we assume that the low-pressure control valve 102*b* has failed to open before the top dead center to avoid piston-valve collision. FIG. 2 shows a simulation of valve clearance and valve lift, versus timing of the cylinder. The top graph shows the control signal for the high-pressure control valve 102*a*, the middle graph shows the control signal for the low-pressure control valve 102*b*, and the bottom graph shows valve lift and clearance (piston-valve clearance profile). The bottom axis of each graph is the crank angle of the engine, which corresponds to the position of the piston.

In operation, high-pressure control valve 102*a* is initially closed to allow high-pressure to build up in reservoir 110. High-pressure control valve 102*a* is opened, which causes plunger 102*e* to actuate valve 106 to open. The initial valve lift is shown as approximately 12 mm and settles quickly at about 10 mm. As the engine piston approaches the valve 106, the valve 106 begins to close (i.e., valve lift decreases). One can see that the piston-valve clearance becomes small as the piston approaches top-dead-center, but piston-valve collision is avoided even before the low-pressure control valve 102*b* is opened.

As a result of the novel mechanical design of the present invention, piston-valve collision can be prevented even if there is a failure in the electronic control system.

While the invention has been described in detail above, the invention is not intended to be limited to the specific embodiments as described. It is evident that those skilled in the art may now make numerous uses and modifications of and departures from the specific embodiments described herein without departing from the inventive concept.

It will be appreciated that the present invention can be implemented in a number of types of internal combustion engines. The engine can have any number of cylinders.

What is claimed:

1. A valve actuation system for use in an internal combustion engine comprising at least one combustion cylinder having a piston and an engine valve, said valve actuation system comprising:

a hydraulic pump configured to produce a hydraulic output based on a valve-piston clearance profile of at least one cylinder of said combustion engine;

a high-pressure reservoir coupled with said hydraulic pump; and an electro-hydraulic valve actuator coupled with said high-pressure reservoir and configured to actuate at least one engine valve of said combustion engine according to an output of said hydraulic pump;

wherein said electro-hydraulic valve actuator includes a control chamber coupled with said high-pressure reservoir and at least one plunger fluidly connected with said control chamber and mechanically connected to said at least one engine valve, and said valve actuation system further comprising at least one feedback loop from said control chamber to said high-pressure reservoir; and wherein said at least one feedback loop comprises a first feedback loop having a first check valve disposed therein, said first check valve configured to allow hydraulic fluid to flow from said control chamber to said high-pressure reservoir when the pressure in said control chamber exceeds the pressure in said high-pressure reservoir.

2. The valve actuation system recited in claim 1, further comprising at least one feedback loop from said electro-hydraulic valve actuator to said high-pressure reservoir, such that when the pressure in said high-pressure reservoir is lower than the pressure in said electro-hydraulic valve actuator, hydraulic fluid travels from said electro-hydraulic valve actuator back to said high-pressure reservoir.

3. The valve actuation system recited in claim 1, wherein said hydraulic pump includes a cam and a plunger, said cam having a shape selected to produce said hydraulic output based on said valve-piston clearance profile of said at least one engine cylinder, such that said plunger moves toward said cam when valve-piston clearance of said piston and said engine valve approaches zero.

4. The valve actuation system recited in claim 1, wherein said at least one feedback loop further comprises a second feedback loop having a control valve disposed therein.

5. The valve actuation system recited in claim 1, wherein said at least one feedback loop further comprises a second feedback loop having a second control valve and a second check valve disposed therein, wherein when said second control valve is open, hydraulic fluid is permitted to flow to low-pressure region, and said second check valve allows hydraulic fluid to flow from low-pressure region to said high-pressure reservoir when the pressure in said high-pressure reservoir is below the pressure in said low-pressure region.

6. The valve actuation system recited in claim 1, further comprising an accumulator coupled with said high-pressure reservoir.

7. The valve actuation system recited in claim 6, wherein said accumulator stores excessive hydraulic fluid and functions such that said check valve is permitted to open in response to high-pressure changes in fluid pressure.

8. A valve actuation method for use in an internal combustion engine comprising at least one combustion cylinder having a piston and an engine valve, said engine comprising an electro-hydraulic valve actuation system for opening and dosing said engine valve, said valve actuation system comprising a hydraulic pump including a plunger mechanically coupled with a cam, said cam moving said plunger to create hydraulic pressure and being mechanically coupled to an engine crankshaft, said electro-hydraulic valve actuation system also including a second plunger fluidly connected with said hydraulic pump and mechanically connected with said engine valve for opening and closing said engine valve, said method comprising steps of:

determining a piston-valve clearance profile of said piston and said engine valve for said, at least one combustion cylinder; and selecting a shape of said cain of said hydraulic pump based on said piston-valve clearance profile, such that said plunger moves toward said cam when valve-piston clearance of said piston and said engine valve approaches zero;

wherein said valve actuation system further comprises a control chamber coupled with a high-pressure reservoir via a control valve, said method further comprising a step of:

coupling an accumulator with said high-pressure reservoir; and providing a feedback loop from said control chamber to said high-pressure reservoir via a check valve, such that when the pressure in said control chamber exceeds the pressure in said high-pressure reservoir, hydraulic fluid flows to said high-pressure reservoir from said control chamber to prevent piston-valve collision.

9. The method recited in claim 8, further comprising a step of configuring said accumulator such that said check valve is permitted to open in response to high-pressure changes in fluid pressure.

10. An electro-hydraulic valve actuation system for use in an internal combustion engine comprising at least one combustion cylinder having an engine piston and an engine valve, said valve actuation system comprising:

a hydraulic pump means for producing a hydraulic output of hydraulic fluid based on a valve-piston clearance profile of at least one cylinder of said combustion engine;

a valve actuation means for actuating at least one engine valve of said combustion engine according to an output of hydraulic fluid of said pump means;

a high pressure-reservoir means coupled with said hydraulic pump;

a control chamber means coupled with said high-pressure reservoir;

feedback means for redirecting hydraulic fluid from said valve actuation means when the engine piston moves close to the engine valve; and a check valve means disposed in said feedback means, for allowing hydraulic fluid flow from said control chamber to said high-pressure reservoir when pressure in said control chamber exceeds pressure in said high-pressure reservoir.

11. The valve actuation system recited in claim 10, further comprising accumulator means for storing excessive hydraulic fluid from the output from said pump means.

* * * * *